US009267324B2

(12) United States Patent
Strand

(10) Patent No.: US 9,267,324 B2
(45) Date of Patent: Feb. 23, 2016

(54) BAND LIFT SYSTEM FOR SHADES

(75) Inventor: Toralf Holte Strand, Kittery Point, ME (US)

(73) Assignee: Hunter Douglas, Inc., Pearl River, NY (US)

( * ) Notice: Subject to any disclaimer, the term of this patent is extended or adjusted under 35 U.S.C. 154(b) by 0 days.

(21) Appl. No.: 13/984,640

(22) PCT Filed: Feb. 10, 2012

(86) PCT No.: PCT/US2012/024575

§ 371 (c)(1),
(2), (4) Date: Oct. 14, 2013

(87) PCT Pub. No.: WO2012/109501

PCT Pub. Date: Aug. 16, 2012

(65) Prior Publication Data

US 2014/0041812 A1 Feb. 13, 2014

Related U.S. Application Data

(60) Provisional application No. 61/441,447, filed on Feb. 10, 2011.

(51) Int. Cl.

| | |
|---|---|
| ***E06B 3/48*** | (2006.01) |
| ***E06B 9/264*** | (2006.01) |
| ***E06B 9/262*** | (2006.01) |
| ***E06B 9/40*** | (2006.01) |
| *E06B 9/24* | (2006.01) |
| *E06B 9/78* | (2006.01) |

(52) U.S. Cl.

CPC ..... *E06B 9/264* (2013.01); *E06B 9/262* (2013.01); *E06B 9/40* (2013.01); *E06B 2009/2447* (2013.01); *E06B 2009/2452* (2013.01); *E06B 2009/2458* (2013.01); *E06B 2009/2622* (2013.01); *E06B 2009/785* (2013.01)

(58) Field of Classification Search

CPC ..... E06B 9/262
USPC ..... 160/84.01, 84.04, 89, 108
See application file for complete search history.

(56) References Cited

U.S. PATENT DOCUMENTS

| | | | | |
|---|---|---|---|---|
| 4,610,290 | A * | 9/1986 | Dorflinger | 160/84.02 |
| 6,481,487 | B2 * | 11/2002 | Simon | 160/84.06 |
| D473,743 | S | 4/2003 | Judkins | |
| 7,063,122 | B2 | 6/2006 | Colson et al. | |

(Continued)

FOREIGN PATENT DOCUMENTS

| | | |
|---|---|---|
| CN | 201433692 | 3/2010 |
| DE | 9015653 | 12/1991 |

(Continued)

*Primary Examiner* — Katherine Mitchell
*Assistant Examiner* — Scott Denion
(74) *Attorney, Agent, or Firm* — Dority & Manning, P.A.

(57) ABSTRACT

Disclosed is a roman shade assembly (100, 200) that utilizes lift bands (108, 208) rather than lift cords. The shade (110, 210) can be formed of textured materials or woven woods. The shade assembly includes lift bands (108,208) that attach to a rotatable member(s) (115, 215) and can be extended or retracted within an architectural opening by rotating the member(s). The lift bands can be slidingly connected to the shade at multiple points along the vertical length of the shade. Accordingly, as the wide lift bands are extended or retracted, the attached shade is likewise extended or retracted to cover or uncover an architectural opening.

32 Claims, 18 Drawing Sheets

(56) References Cited

U.S. PATENT DOCUMENTS

| | | | | |
|---|---|---|---|---|
| 7,353,857 | B2 | 4/2008 | Koop | |
| 7,571,756 | B2 | 8/2009 | Smith et al. | |
| 8,281,842 | B2 * | 10/2012 | Lin | 160/84.04 |
| 8,668,002 | B2 * | 3/2014 | Chen | 160/89 |
| 2008/0142171 | A1 | 6/2008 | Koop et al. | |
| 2008/0230189 | A1 | 9/2008 | Rossato et al. | |
| 2008/0295975 | A1 * | 12/2008 | Lin | 160/84.04 |
| 2009/0283223 | A1 | 11/2009 | Liu | |
| 2010/0126678 | A1 * | 5/2010 | Lin | 160/340 |
| 2010/0269984 | A1 * | 10/2010 | Hanley et al. | 160/84.04 |
| 2010/0269985 | A1 * | 10/2010 | Hanley et al. | 160/84.04 |
| 2010/0269987 | A1 * | 10/2010 | Martin et al. | 160/309 |
| 2010/0294438 | A1 * | 11/2010 | Kirby et al. | 160/84.04 |
| 2011/0162806 | A1 * | 7/2011 | Lin | 160/84.04 |
| 2011/0186240 | A1 * | 8/2011 | Lin | 160/84.01 |
| 2011/0253324 | A1 | 10/2011 | Lin | |
| 2012/0067527 | A1 * | 3/2012 | Cheng | 160/84.02 |
| 2013/0160953 | A1 * | 6/2013 | Perkowitz | 160/84.01 |

FOREIGN PATENT DOCUMENTS

| | | |
|---|---|---|
| EP | 2369119 | 9/2011 |
| EP | 2372073 | 10/2011 |
| WO | WO 2011/005700 | 1/2011 |

* cited by examiner

BAND LIFT SYSTEM FOR SHADES

CROSS REFERENCE TO RELATED APPLICATION

The present application is the U.S. national filing of International Patent Application Number PCT/US2012/024575 having a filing date of Feb. 10, 2012, which claims filing benefit of U.S. Provisional Patent Application Ser. No. 61/441,447 having a filing date of Feb. 10, 2011, which is incorporated herein by reference.

BACKGROUND

Various different types of coverings exist for placement in architectural openings, such as windows, doors, archways and the like. Such coverings include roman shades as illustrated in FIG. 1. Roman shades comprise a covering 10, often formed of woven wood, that is placed in an architectural opening. As shown in FIG. 1, a roman shade includes a head rail assembly 12 that not only mounts the shade within the opening, but also provides a control mechanism for raising and lowering the shade as desired. The control mechanism includes vertical cords 14 that extend from the head rail assembly to the hem of the shade where they are connected to the shade. The cords are also slidingly connected to the shade at regular intervals 16 from the hem to the head rail, for instance by the use of rings connected at regular intervals along a vertical length of the shade, often in conjunction with horizontally placed battens or dowels 18. At the head rail 12, the cords are windingly received around a roller tube 15 and, as the tube is rotated, the cords are wrapped around the tube 15. This causes the shade 10 to fold and gather at the sliding connections 16 between the cords and the fabric as the cord 14 is wrapped on the roller tube 15, and the shade is raised such that the fabric hangs in a plurality of pleats having a desired drop length.

Rotating the roller of the head assembly in one direction causes the shade to extend and rotating the roller in an opposite direction causes the shade to retract. The roller is usually controlled by a manually driven control mechanism, though automatic mechanisms can also be used. Roman shades often include a variety of aesthetically appealing components, such as a valence 20 as illustrated in FIG. 2 that can cover all or part of the head rail and shade 10.

Unfortunately, the utilization of cords on shade coverings can lead to several undesirable characteristics. For instance, the cords can become tangled and can also become entangled with other objects, which can be problematic. In an attempt to alleviate such problems, roman shades have been formed such that the distance between lift points is be less than 8 inches, so as to decrease the distance between attachment points when the shade is lowered, preventing accidental entanglement with the cord. The limited distance between lift points can lead to the formation of additional pleats when the shade is raised and undesirable thickness of the raised shade, particularly when considering thicker shade materials such as woven wood. Additionally, no matter what the spacing between lift points on a shade, utilization of cords can form a visible line when viewed from the front of the shade, which can also be less than desirable.

In view of the above, a need currently exists for a roman shade that does not utilize lift cords while also providing an aesthetically pleasing presentation.

SUMMARY

According to one embodiment, disclosed is a roman shade assembly that can include a shade having a first end and a second and opposite end, a lift band slidably connected to the shade at a plurality of connection points between the first and second ends, and a rotatable member to which the lift band is attached. At least one of the connection points between the shade and the lift band can be a slidable connection point that allows the lift band to slide past the shade at the connection point. In addition, one of the connection points is a fixed connection point at the hem of the shade. Upon rotating the rotatable member in a first direction the shade can extend, and upon rotating the rotatable member in the opposite direction the lift band can wind around the rotatable member and cause the shade to retract. The shade can be formed of, e.g., a textile or a woven wood.

According to one embodiment, the connection points between the shade and the lift bands can be removably attachable to the shade, allowing the connection points to be moved and the overall look of the retracted shade to be variable. The utilization of removably attachable connection points can also simplify assembly of a shade and can allow for either large or small drop length on a shade, depending upon the desired appearance of the retracted shade.

According to one embodiment, a shade can include a horizontal tab on the back of the shade. The horizontal tab can define a hole or slot therethrough that can form a slidable connection point between the shade and the lift band. Thus, the hole through the horizontal tab can have an aspect ratio greater than one to accommodate the lift band therethrough. The horizontal tab can be defined by the shade itself, such as by a fold in the shade material itself, can be defined by a backing material, or can be formed from another material that can be attached to the shade.

Also disclosed is a backing sheet that can be slidably connected to a lift band. For example, a backing sheet can be adhered to a roman shade and the roman shade can be retracted and extended by the connection points on the adhered backing sheet. For example, a backing sheet can be directly adhered to a shade and the backing sheet can include one or more horizontal tabs that define the connection points used in conjunction with a lift band to raise and lower the shade. Alternatively, the backing sheet can be adjacent to but separated from a shade.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
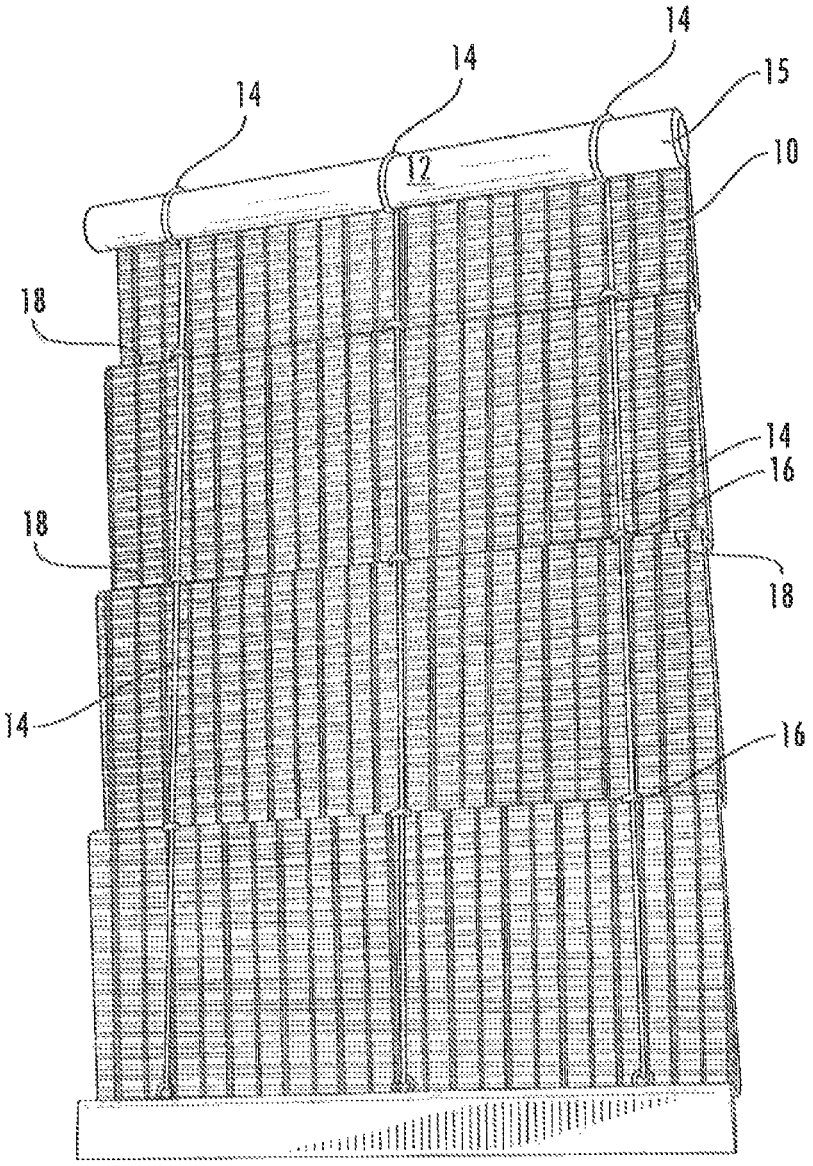
FIG. 1 illustrates the back of a roman shade as is known in the art.
Figure 2:
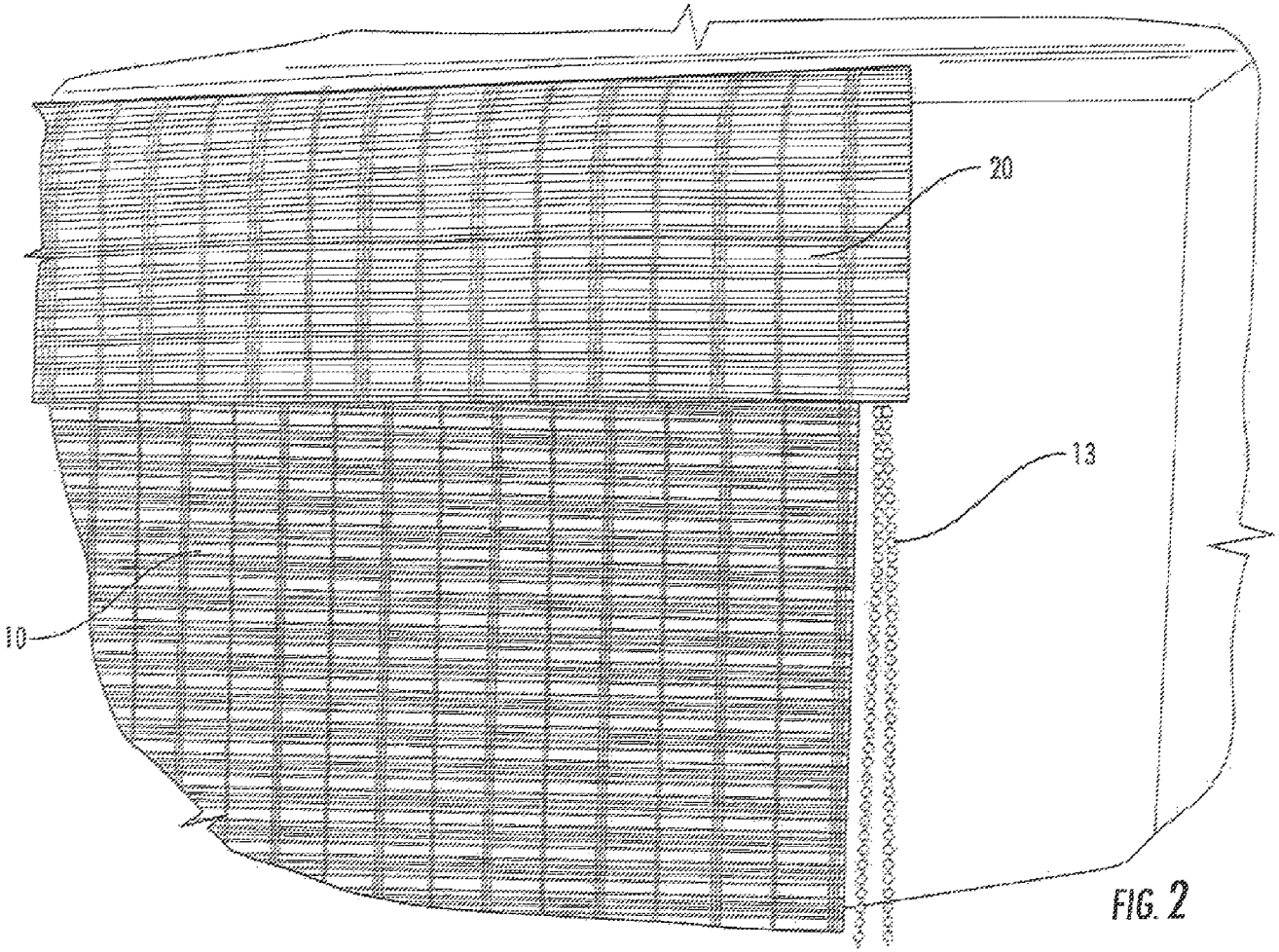
FIG. 2 illustrates the head rail section of a roman shade as is known in the art.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a roman shade assembly that utilizes lift bands rather than cords. In one embodiment, the roman shade assembly is well suited for use with a shade made from a textured material. The textured material may be relatively heavy and/or stiff. The roman shade assembly is particularly well suited in one embodiment for use with shades made from woven woods. The roman shade assembly includes one or more rotatable members that can be mounted adjacent the top of an architectural opening and adjacent the top of the shade. The lift band(s) can be attached to the rotatable member(s) and can be extended or retracted within the architectural opening by rotating the member(s). In accordance with the present disclosure, the lift bands are slidingly connected to the shade or a backing sheet of the shade at multiple points along the vertical length of the shade and are fixed near or at the bottom of the shade. Accordingly, as the lift bands are extended or retracted, the shade and/or backing sheet is likewise extended or retracted to cover or uncover the architectural opening. As the shade is retracted, a series of pleats can form between the gathered connection points that can have a characteristic drop length.

Figure 3:
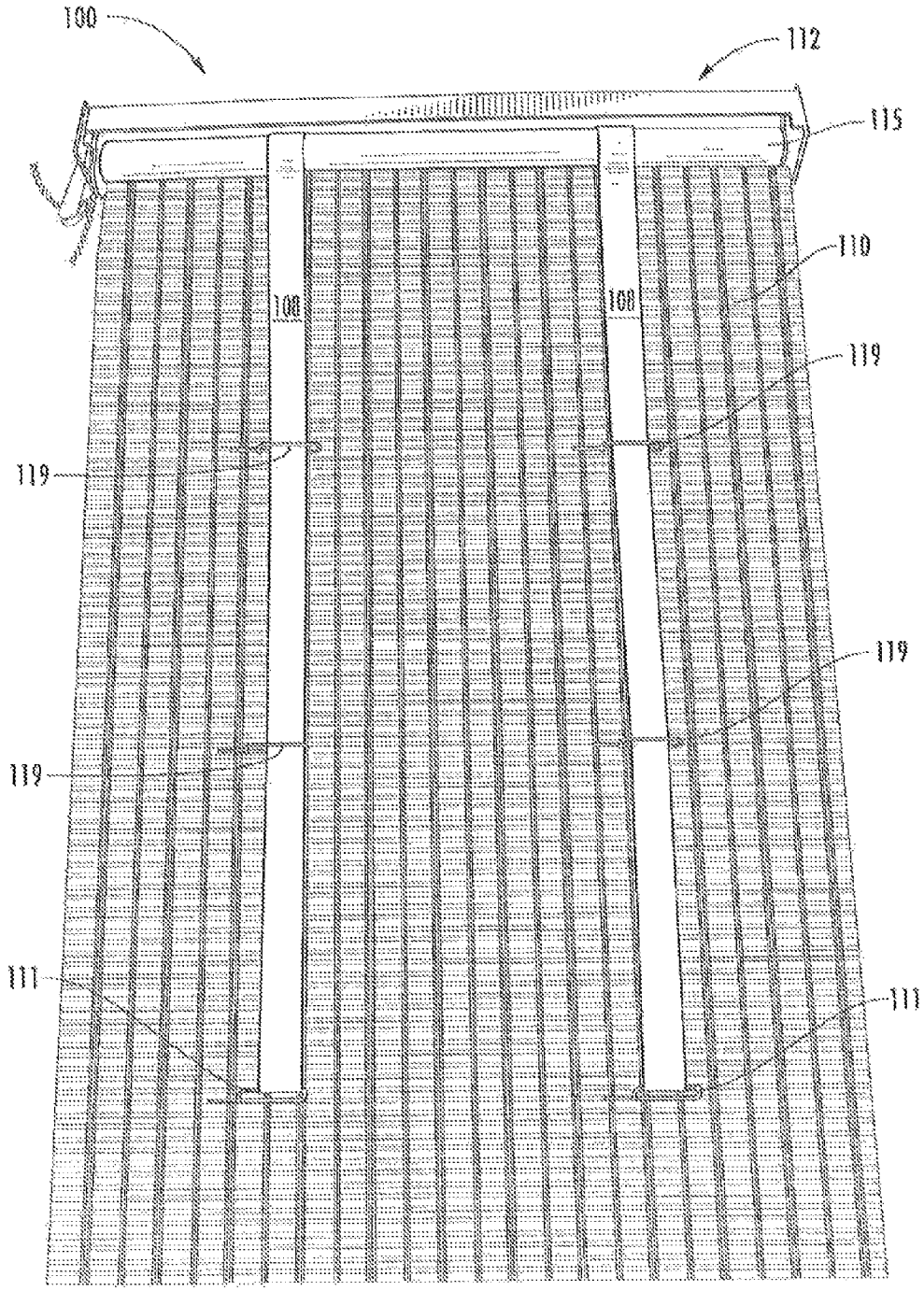
FIG. 3 illustrates the back of a roman shade as described herein.
Figure 7:
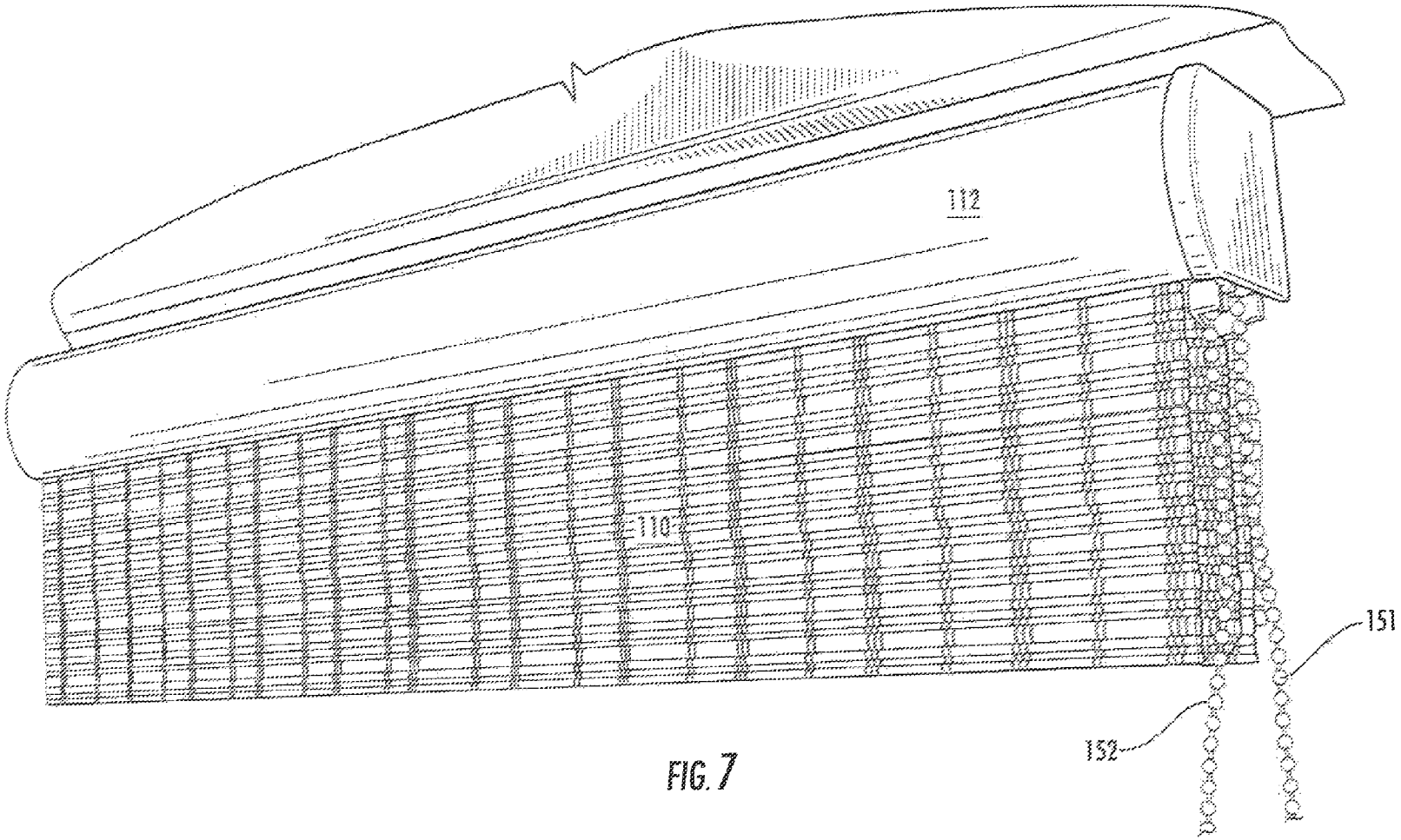
FIG. 7 illustrates a roman shade as described herein in a fully raised position.

Referring to FIG. 3 one embodiment of a roman shade assembly 100 made in accordance with the present disclosure is shown. As illustrated, the roman shade assembly 100 includes a shade 110 that is attached to two lift bands 108 at multiple connection points 111, 119. The lift bands 108 are in turn attached to a cylindrical member 115 in the head rail 112. More particularly, one end of each lift band 108 is attached or connected to the cylindrical member 115. One end of each lift band 108, for instance, can be adhered to the cylindrical member 115 using an adhesive or can be mechanically affixed to the cylindrical member by being, for instance, inserted into a slot. The other end of each lift band 108 can be adhered to the shade at secure connection points 111. In addition, each lift band can include a series of slidable connection points 119 that slidably connects the lift band to the shade along the vertical length of each lift band. The cylindrical member 115 is rotatably mounted within the roller shade assembly. Thus, rotating the cylindrical member 115 in one direction causes the lift bands 108 to extend and lower the shade 110 and rotating the cylindrical member 115 in an opposite direction causes the lift bands 108 to wind around the cylindrical member 115 (see FIG. 5) and retract and raise the shade 110 with a series of pleats each having a desired drop length formed in the shade as the shade is raised and the connection points are gathered and stacked together (see FIG. 7).

A shade 110 can be formed of any material as is generally known in the art. In one embodiment, the roman shade assembly 100 as shown in the figures is particularly well suited for use with shades made from highly textured materials. In FIG. 3, for instance, the shade 110 comprises a woven wood material. A woven wood material can be made from, e.g., natural wood, grasses, bamboo, jute, reeds, or mixtures thereof. Woven woods are generally highly textured and tend to be relatively stiff across the width of the shade. A woven wood can be formed with either a tight or loose weave, as is generally known in the art.

In addition to woven woods, it should be understood, however, that a shade can be made from any suitable material, and in one embodiment any textured, relatively stiff and/or heavy material. Textured materials, for instance, generally refer to materials having a non-uniform thickness. The shade material, for instance, may have a thickness that varies by at least about 2%, such as at least about 5%, such as at least about 7%, such as at least about 10%, over the surface area of the material.

Figure 4:
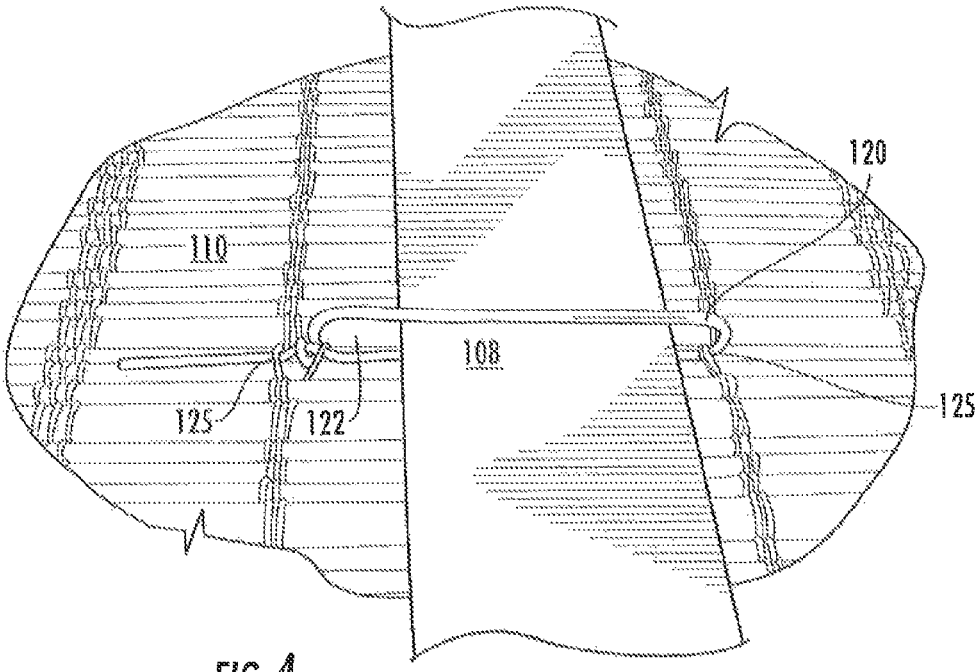
FIG. 4 illustrates a sliding attachment point of a roman shade as described herein.

In accord with one embodiment of the present disclosure, one or more lift bands 108 can be attached to the back of a shade 110 of a roman shade assembly 100. As shown in FIG. 4, a lift band 108 can be wider than a cord, for instance a lift band can have a cross sectional aspect ratio that is greater than 1. As utilized herein, the cross sectional aspect ratio is intended to refer to the ratio of the thickness of a cross section of the a lift band to the width of the cross section of the lift band, the thickness and width being perpendicular to one another. When considering a lift band with a non-rectangular cross section, e.g., an oval-shaped cross section, the thickness and width dimensions are the minor axis and the major axis of the cross section, respectively. In general, a lift band can have a thickness dimension that is less than that of a typical lift cord and a width that is greater than that of a typical lift cord. By way of example, a lift band can have a cross sectional width that is greater than about ¼ inch, greater than about ½ inch, or greater than about 1 inch. A lift band can have a cross sectional thickness that is less than about 0.1 inch, for instance less than about 0.05 inch, or less than about 0.01 inch, in one embodiment. For example, a lift band cross section can be between about 2 and about 10 inches in width and less than about 0.010 inches in thickness. The cross sectional dimensions of lift band 108 can prevent possibility of band entanglement with itself or other structures and can provide an aesthetically pleasing shade from both the front and back.

A lift band can be formed of any material that exhibits suitable flexibility so as to be collected in a head rail (e.g., wrapped around a cylindrical member 115 of a head rail 112) and that can be both slidingly connected to a shade at connection points 119 and securely connected to a shade at the hem of the shade at connection points 111. In addition, a band can exhibit limited stretch. By way of example a lift band can be formed of a textile material or a polymeric tape.

The term 'textile' as utilized herein generally refers to any structure produced by the interlacing of yarns, multi-filament fibers, monofilament fibers, or some combination thereof. A textile can be generally planar or can be manipulated to form higher dimensional geometries. A textile can include fibers in a predetermined, organized, and interlaced pattern, herein referred to as a weave or knit fabric (i.e., a fabric formed according to a weaving and/or knitting process), or optionally can include the fibers in a random pattern (a nonwoven fabric), or in a unidirectional prepreg fabric, in which multiple unidirectional fibers are aligned and held in a matrix of a polymeric binding agent.

A lift band can be formed of a textile of any suitable basis weight. For instance, a lift band can be formed of a relatively light weight textile, for example a nonwoven web having a basis weight of, e.g., between about 0.5 ounces per square yard and about 3 ounces per square yard. A light weight web can be translucent, and as such can cast little shadow and can be less visible when viewed from the front of the shade, even when considering a shade that is itself somewhat translucent, e.g., having an open weave. Of course, a heavier textile can also be utilized as a lift band, for instance a web having a basis weight of greater than about 3 ounces per square yard. A heavier textile can be preferred in those embodiments in which a shade is itself relatively heavy.

In one embodiment, a lift band can be formed of a polymeric film, such as a polyester, a polycarbonate, or polyolefin film. For instance, a transparent polymeric film can form a lift band. A transparent polymeric material can provide a lift band that is less visible on a shade. For example, when considering an open weave shade of a textile or a woven wood, a transparent lift band can be essentially invisible, particularly when viewed from the front of the shade, even when the shade is in full sunlight.

In one embodiment, a polymeric tape lift band can have a surface finish, for instance a matte finish, and can provide a less visible lift band to a shade system. For instance, a polyester tape having a slight matte finish can be utilized in one embodiment. Exemplary polymeric tapes as may be utilized in a roman shade system include those available from SMI Gaskets of Sante Fe Springs, Calif.

Referring again to FIG. 3, a lift band 108 can be slidingly connected to a shade 110 at multiple connection points 119 along the vertical length of a shade 110. As utilized herein, the terms vertical and horizontal are intended to refer to the vertical and horizontal of a hung shade, i.e., vertical is considered to be the longitudinal length of a shade that is perpendicular to the ground or floor when the shade is hung in a standard fashion, and the horizontal direction is parallel to the ground or floor when the shade is hung.

Beneficially, as the lift band 108 lessens the possibility of tangling and entanglement as compared to utilization of previously known lift cords, the distance between adjacent sliding connection points 119 and between the lowest sliding connection point 119 and fixed connection point 111 can be greater than the 8 inch maximum for lift cords found in current roman shades. By way of example, adjacent connection points can be greater than eight inches apart, or greater than about 10 inches apart, in one embodiment. For instance, the distance between adjacent connections points can be between eight inches and about 24 inches. Of course, in other embodiments, the distance between connection points can be less (i.e., smaller drop length), for instance in those embodiments in which a larger uncovered expanse of an architectural opening is desired when the shade is fully retracted. According to this embodiment, the connection points can be less than about eight inches apart, for instance between about three and about eight inches apart, for instance about four inches apart.

The increased variability capable between adjacent vertical connection points can allow for increased design capabilities of a system. For example, a 36 inch shade can have the connection points located with a six inch spacing, while a 72 inch shade can have the connection points located with a 12 inch spacing, both shades having six full pleats when the shade is gathered in a raised orientation. This can be particularly beneficial when a shade is formed of a heavily textured material, such as a woven wood. The ability to form a shade assembly with greater distance between adjacent connection points can decrease the total number of pleats formed when the shade is in a raised orientation, which also decreases the thickness of the gathered shade. This can improve the look of the raised shade, particularly when a shade assembly includes a valence.

The increased variability in the distance between adjacent connection points can be used to improve the overall appearance of the shade, particularly when raised, for instance when a shade includes a patterned front. For example, a shade can be woven or printed with a patterned front and the vertical pattern dimension can be coordinated with the distance between adjacent connection points of the shade. By way of example, a three inch vertical pattern on the front of a shade can have three, six, nine, or twelve inch adjacent connection points coordinated with the shade pattern.

Figure 6A:
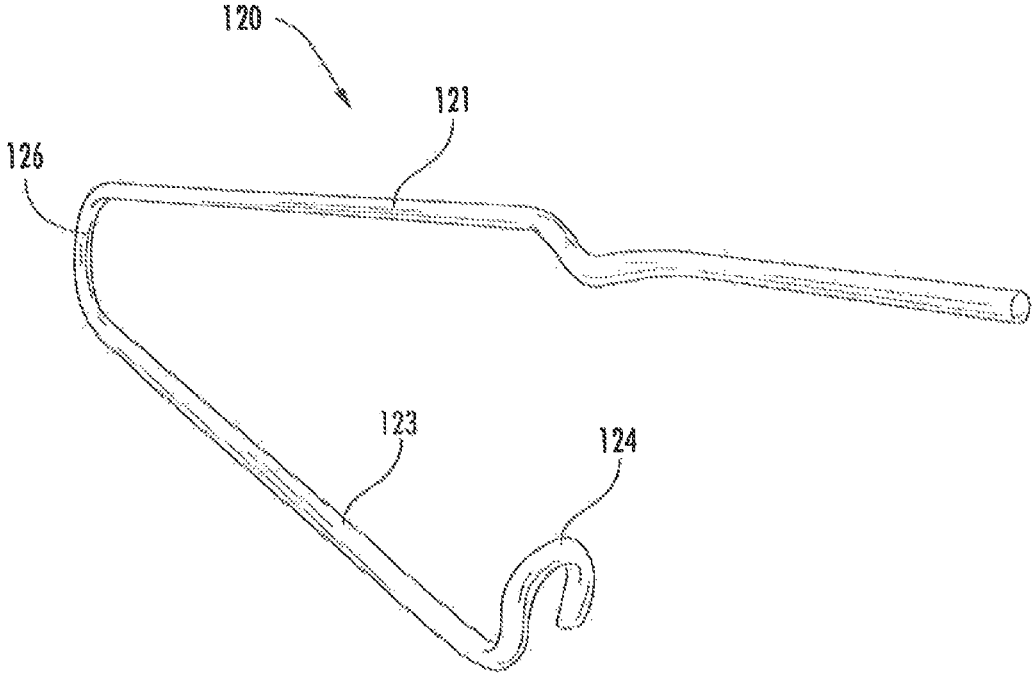
FIG. 6A and FIG. 6B illustrate attachment pins as may be utilized in conjunction with a roman shade as described herein.
Figure 6B:
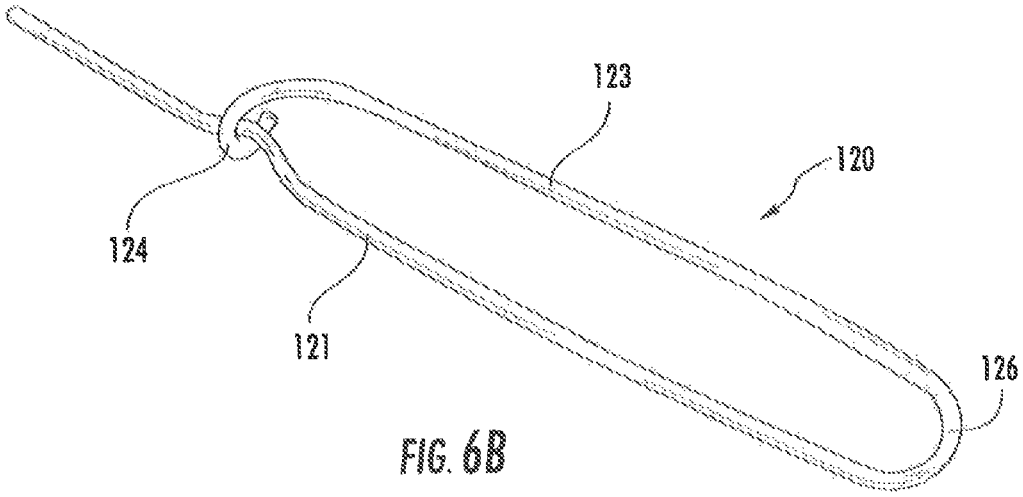

As seen in FIG. 4, a slidable connection point can be provided in one embodiment by use of a pin 120 that can be secured to a shade 110 and can define an opening 122 through which a lift band 108 can freely slide. A pin 120 can be permanently or removably attachable to a shade. By way of example, FIGS. 6A and 6B illustrate a pin 120 that can be removably attached to a shade 110. The pin 120 includes a member 121 that can pass through a material of a shade and a member 123 including latch 124. Member 121 and member 123 can be unitary through a bend 126, as illustrated, or alternatively can be attached to one another through a joining member, as is known. Members 121, 123 can flex with respect to one another so as to provide the latch in an open position, as in FIG. 6A and in a closed position, as in FIG. 6B.

FIG. 4 illustrates a pin 120 with latch 124 in a closed position and the pin member 121 passing under warp yarns 125 of a woven wood shade 100. As can be seen, pin 120 can be formed to a size such that bend 126 and latch 124 fit between two warp yarn sections of shade 100. Of course, this is not a requirement of disclosed systems, and such an arrangement is but one method for providing a secure attachment between a slidable connection point and a shade or backing sheet.

In this illustrated embodiment, pin 120 is removably attached to shade 100. Specifically, latch 124 can be opened and member 121 slid out from engagement with warp yarns 125 to remove pin 120. A removable attachment device, such as removable pin 120 can provide a route for simple alteration of the connection points on a shade and related alteration of the appearance of the gathered pleats upon raising the shade.

Of course, a pin can be more permanently secured to a shade by adhesively or otherwise attaching the pin to the shade. Moreover, any other attachment device as is generally known in the art can alternatively be utilized to provide connection points between a lift band and a shade. For instance, an elongated ring can be sewn or adhesively secured to the back of a shade.

Referring again to FIG. 3, at the hem of shade 110 (e.g., the hem can be approximately ½ of the drop length of the shade), lift bands 108 can be securely fixed to shade 110 at connection points 111. In the illustrated embodiment, connection points 111 have been formed with a pin 120 as discussed above, though alternative fixed connections could be utilized. In the illustrated embodiment, lift bands 108 have been passed around member 121 of pin 120 and secured to themselves, forming a closed loop in the end of lift bands 108. Any similar securement can be utilized, provided a lift band 108 can slide freely through slidable connection points 119 and avoid tangles with itself upon raising and lowering the shade. For example, the end portions of lift bands 108 can be sewn or otherwise adhered directly to shade 110.

Figure 8A:
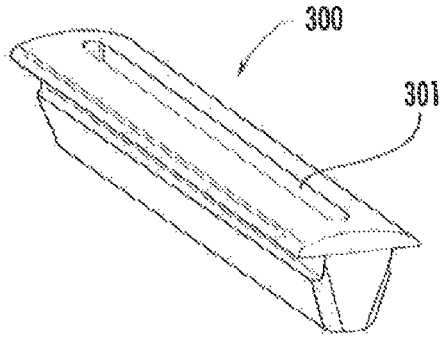
FIGS. 8A-8E present several views of a fastener for securing a lift band to the hem of a roman shade system.
Figure 8B:
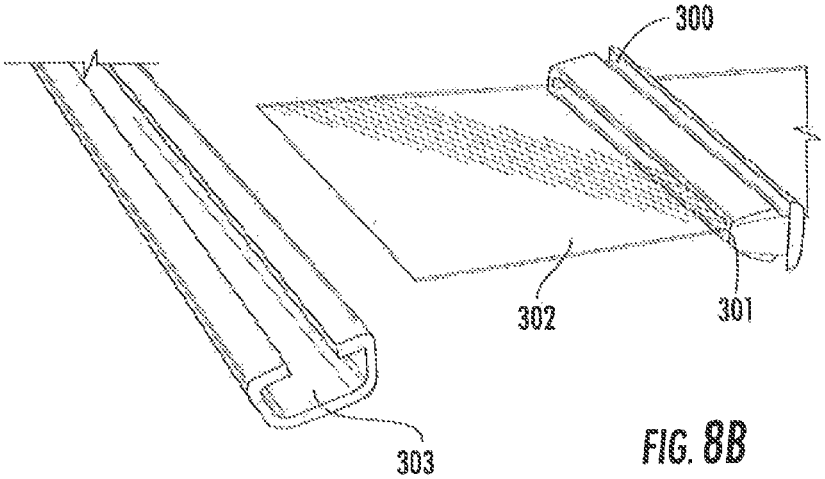
Figure 8C:
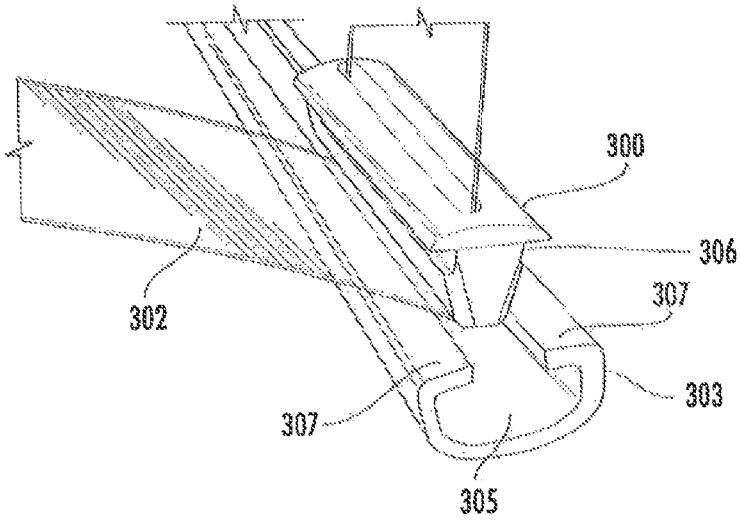
Figure 8D:
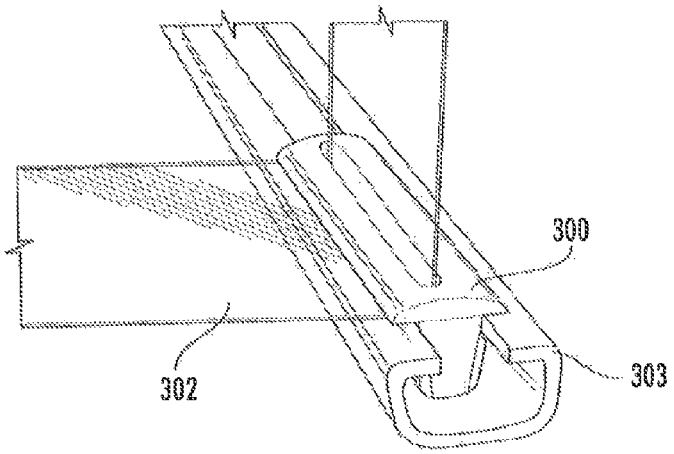

By way of example, FIGS. 8A-8E illustrate a method and device for securing the end of a lift band at the hem of a shade. As can be seen, FIG. 8A illustrates a tape retainer 300 that includes a slit 301 through which a lift band can be slid. In FIG. 8B, a lift band 302 extends through the slit 301 of the tape retainer 300. Also shown in FIG. 8B is a tie-off bar 303 that can be attached to a shade or a backing sheet to form a connection point at the hem. As shown in FIG. 8C, the tape retainer 300 can be located within an opening 305 of the tie-off bar 303. The dimensions of the tie-off bar 303 and tape retainer 300 can be such that the tape retainer 300 will not be easily removed from the opening 305 of the tie-off bar 303 following attachment to one another. An end of lift band 302 can be held securely between the tape retainer 300 and the tie-off bar 303 so as to prevent motion of the lift band 302 through the tape retainer 300. For instance, the end of the lift band 302 can wrap partially around the exterior of the tape retainer 300 and be held between the tape retainer 300 and the tie-off bar 303, as shown in FIG. 8D. Moreover, tape retainer 300 can define ridges 306 (FIG. 8C) that can interlock with tabs 307 of tie-off bar 303 and thus, following insertion of the tape-retainer 300 into the opening 305 of the tie-off bar 303, the two can be secured together.

Figure 8E:
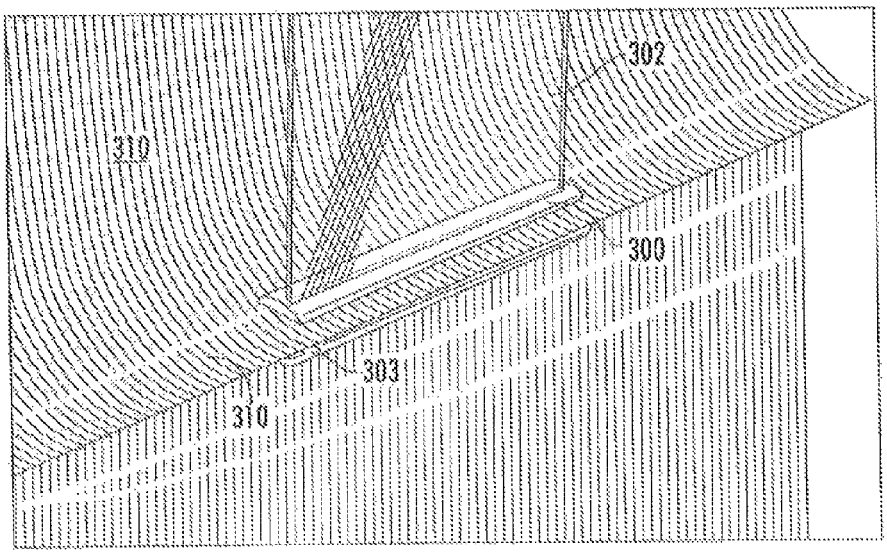

In FIG. 8E is shown a fastening system following assembly including a tape retainer 300 attached to a tie-off bar 303. In this embodiment, the fastening system is secured to a backing sheet 310 of a roman shade system. The lift band 302 passes through the slit of the tape retainer 300 and is then secured between the tape retainer 300 and the tie-off bar 303, as described above. As can be seen, a portion of the material of backing sheet 310 is between the tie-off bar 300 and the tape retainer, providing additional coupling to the system between the connection point and the material of backing sheet 310. In this particular embodiment, the tie-off bar 303 extends and is secured across a horizontal length of the backing sheet 310, though this is not a requirement of the fastening system.

Referring again to FIG. 5, the roller shade assembly can include a head rail 112. Head rail 112 can house cylindrical member 115 as well as a control mechanism 130. The control mechanism 130 can be operatively connected to at least one end of the cylindrical member 115. The control mechanism 130 is for rotating the cylindrical member 115 and causing the shade 110 to extend or retract.

In general, any suitable control mechanism can be used in conjunction with the shade system of the present disclosure. In the embodiment illustrated, for instance, a manual control mechanism 130 is shown that includes a cord 150.

A cord 150 can either be an endless loop that is affixed to the wall or wall opening or can have separate, detached ends. In other embodiments, however, the control mechanism 130 may comprise an electric motor or any other suitable device capable of rotating the cylindrical member 115. For instance, a control mechanism can include a cordless system that includes an automatic winding mechanism or a cordless balanced system. Automatic winding mechanisms are generally known in the art and have been described, for instance in U.S. Patent Application Publication 2009/0283223 to Liu, which is incorporated herein by reference. When utilizing an automatic winding mechanism, a user can provide suitable pressure at the base of a shade, thereby instigating the automatic winding mechanism to retract or extend the shade. A cordless balanced system as is known can alternatively be utilized. For example, spring balanced system as described in U.S. Pat. No. 7,063,122 to Colson, et al., which is incorporated herein in its entirety by reference, can be utilized.

Figure 5:
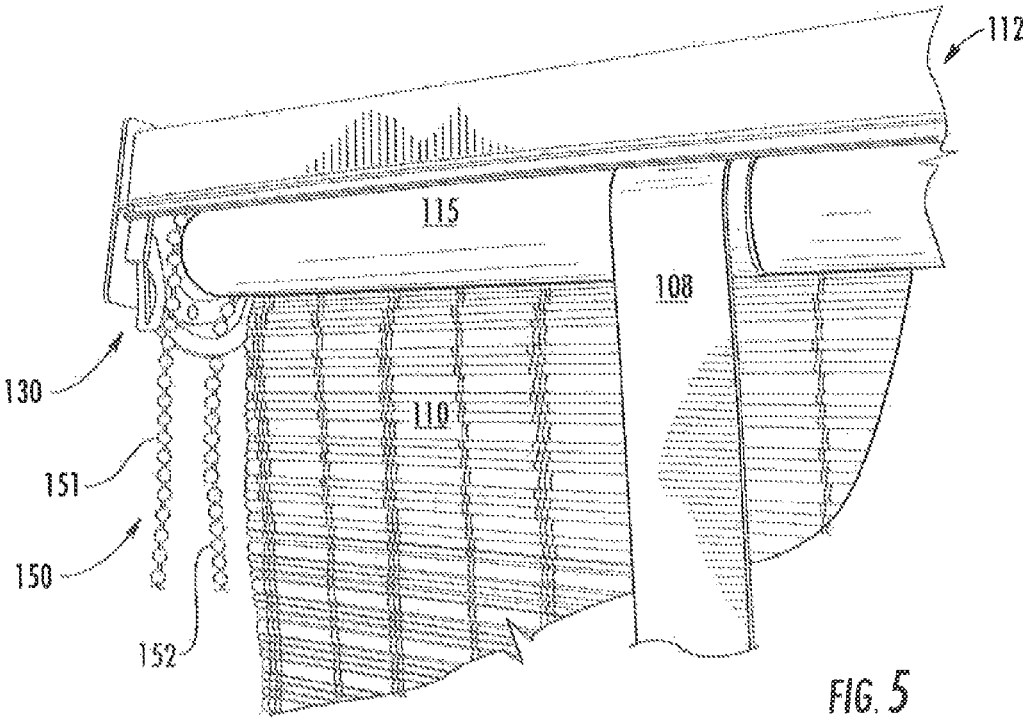
FIG. 5 illustrates the head rail section of a roman shade as described herein.

The manual control mechanism 130 illustrated in FIG. 5 comprises a ball chain cord 150 in the shape of an endless loop. The cord 150 at one end engages a sprocket wheel and engages at the opposite end a tensioning device (not shown). The tensioning device is configured to be mounted within the architectural opening for providing tension to the cord 150. The cord 150 is looped over and operatively connected to the sprocket wheel, which is in turn operatively connected to the cylindrical member 115 via a clutch device. By pulling on one of the chain portions 151 and 152, a user can rotate the sprocket wheel to a desired direction for extending or retracting the shade 110.

In one embodiment, the sprocket wheel can include a circumferential outer surface with a plurality of radially extending sprocket teeth that form pockets. In such an embodiment, the balls of the cord 150 fit within the pockets of the sprocket wheel. The housing of head rail 112 helps to maintain the cord 150 suitably engaged with the pockets of the sprocket wheel. In particular, the housing is designed to prevent the cord 150 from disengaging the sprocket wheel. In this arrangement, pulling one of the chain portions causes the bails on the cord to engage the sprocket wheel and to rotate the sprocket wheel a desired direction. In one embodiment, a stop mechanism can also be associated with the cord 150 for preventing the sprocket wheel from being over rotated in a certain direction.

Thus, pulling one of the chain portions 151 or 152 causes the cord 150 to engage the sprocket wheel and to rotate the sprocket wheel counter clockwise or clockwise. The cylindrical member 115 rotates with the sprocket wheel for rolling or unrolling the shade 110.

In another embodiment, rather than a single cylindrical member upon which multiple lift bands are wound, as illustrated, a head rail can include a single shaft that can be in mechanical communication with a control mechanism, for instance a sprocket wheel as described. A plurality of spools can be driven by the single shaft, and each spool can be connected to a single lift band. Accordingly, as the single shaft is rotated, each lift band can be wound or unwound from the associated spool.

Figure 9A:
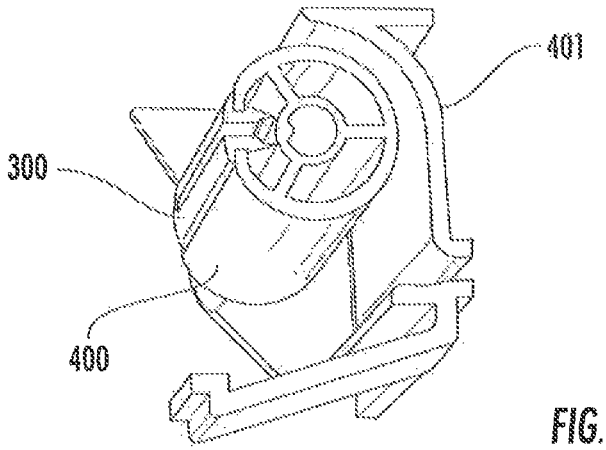
FIGS. 9A-9E present several views of a spool system as may be utilized for securing a lift band to a head rail of a roman shade system.

FIGS. 9A-9E illustrate one embodiment of a head rail embodiment including a tape spool 400 upon which a lift band of a system can be individually wound. With reference to FIG. 9A, a tape spool 400 can be formed so as to be attachable to a tape retainer 300 as illustrated in FIG. 8A. More specifically, the end of a lift band (not shown in FIG. 9A) can be slid through the slit 301 of the tape retainer 300 as described above. The tape retainer 300 can then be located in an opening defined in the tape spool 400, as shown, thereby securing the end of the lift band to the tape spool 400. The tape spool 400 can be located within a tape spool frame 401, a cut-away view of which is provided in FIG. 9A.

Figure 9B:
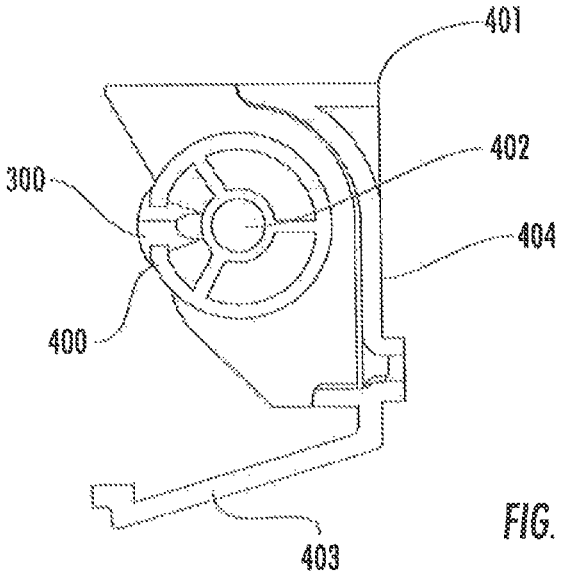

FIG. 9B illustrates a side view of the cut-away view of FIG. 9A. As can be seen, an opening 402 is defined through the tape spool 400 and through the tape spool frame 401 through which a shaft of the head rail can pass. Tape spool frame 401 includes arm 403 and support structure 404 for locating and holding a tape spool frame 401 in a head rail.

Figure 9C:
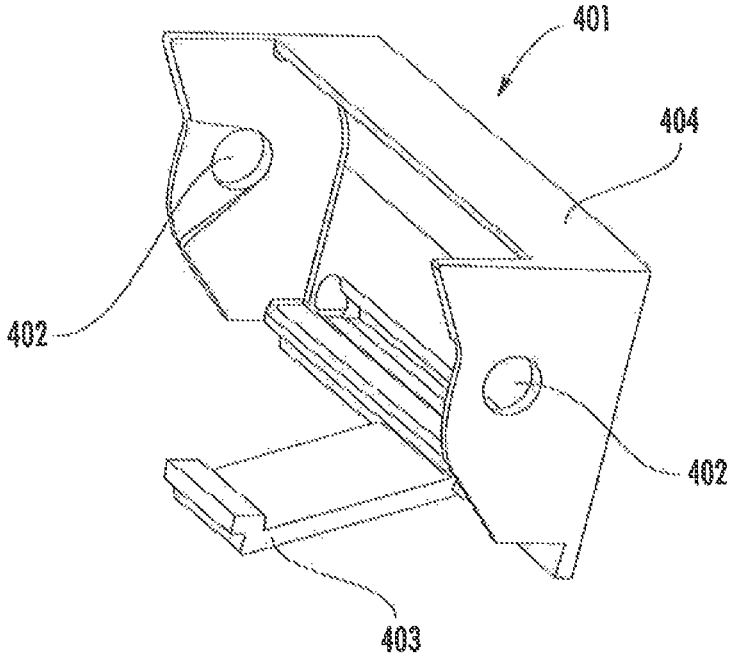

FIG. 9C provides a perspective view of a tape spool frame 401, more clearly showing the openings 402 through which a shaft of the head rail can pass and also illustrating the arm 403 and support structure 404 for securing the tape spool frame 401 in the head rail.

Figure 9D:
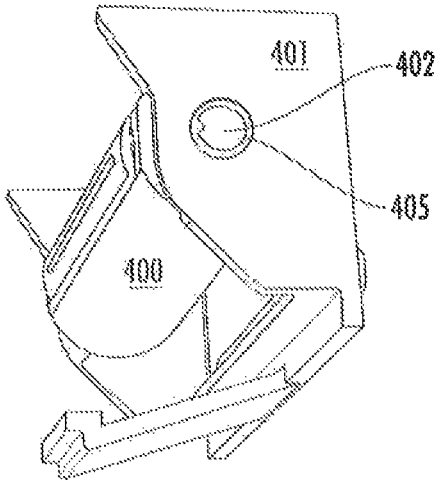

FIG. 9D is a perspective view of a tape spool 400 located within a tape spool frame 401. Tape spool 400 can be secured within tape spool frame 401 merely by the shaft of the head rail that passes through the openings 402. Optionally, tape spool 400 and tape spool frame 401 can define interlocking pieces, e.g., a ridge 405 defined at the opening 402 of tape spool 400 that fits within the opening 402 defined by tape spool frame, so as to provide additional securement between the two.

Figure 9E:
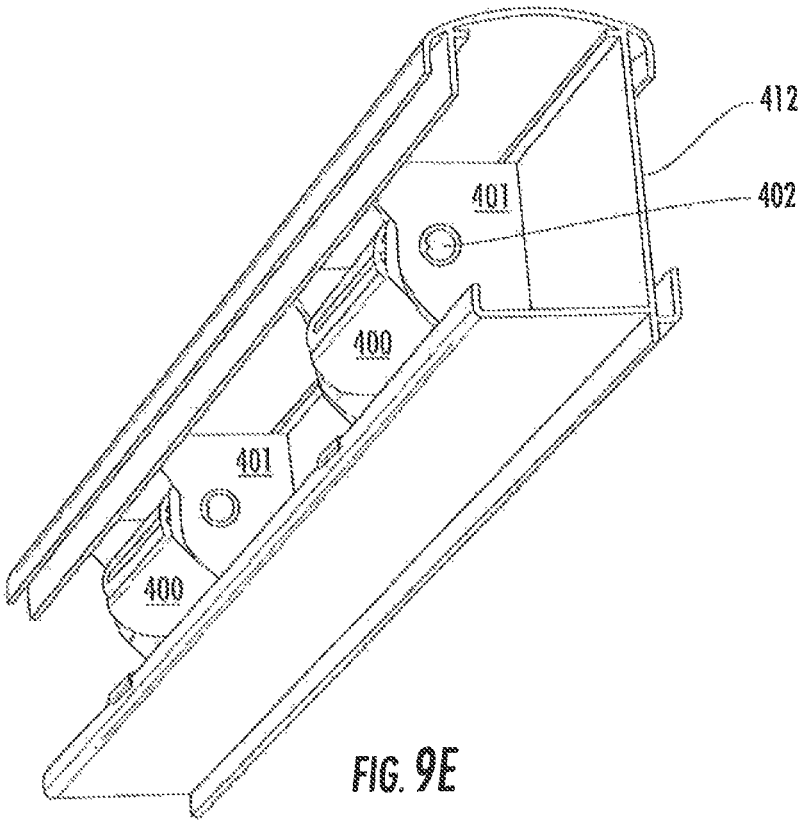

FIG. 9E illustrates two tape spools 400 within their respective tape spool frames 401 following insertion in a head rail 412. Head rail 412 can define various features as are generally known in the art for securement to the top of an architectural opening, e.g., a window or archway. A shaft (not shown) can pass through the openings 402 of the tape spool/tape spool frame structures that can function in conjunction with a control mechanism, as described above and as is generally known in the art.

Suitable control mechanisms that may be incorporated into the roller shade assembly of the present disclosure are disclosed, for instance, in U.S. Pat. No. 7,353,857 to Koop, U.S. Pat. No. 7,571,756 to Smith, et al., and in U.S. Patent Application Publication No. 2008/0142171 to Koop, et al., which are all incorporated herein by reference.

Figure 10:
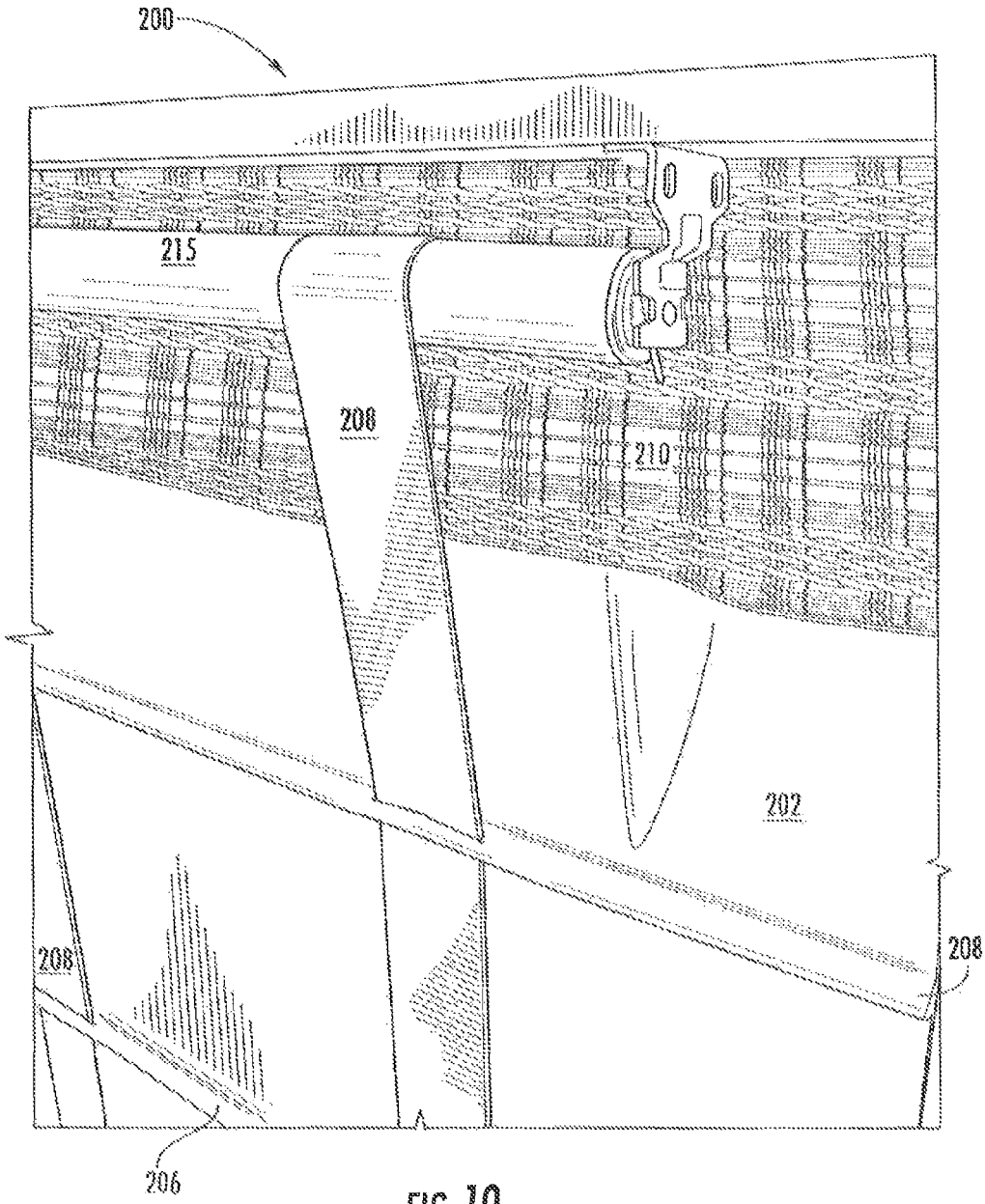
FIG. 10 illustrates an embodiment of a roman shade as disclosed herein.
Figure 11:
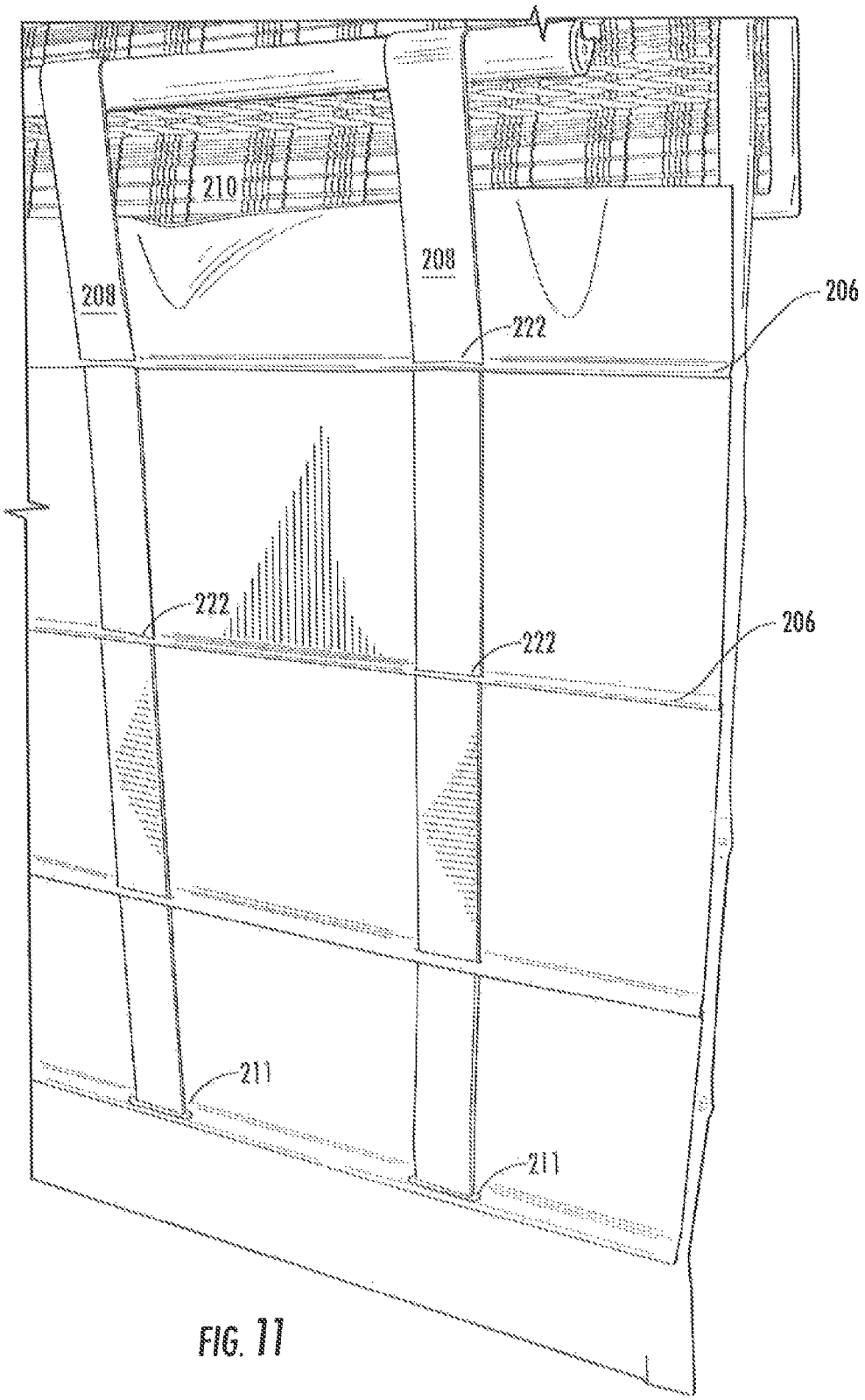
FIG. 11 is another view of the roman shade of FIG. 10.
Figure 12:
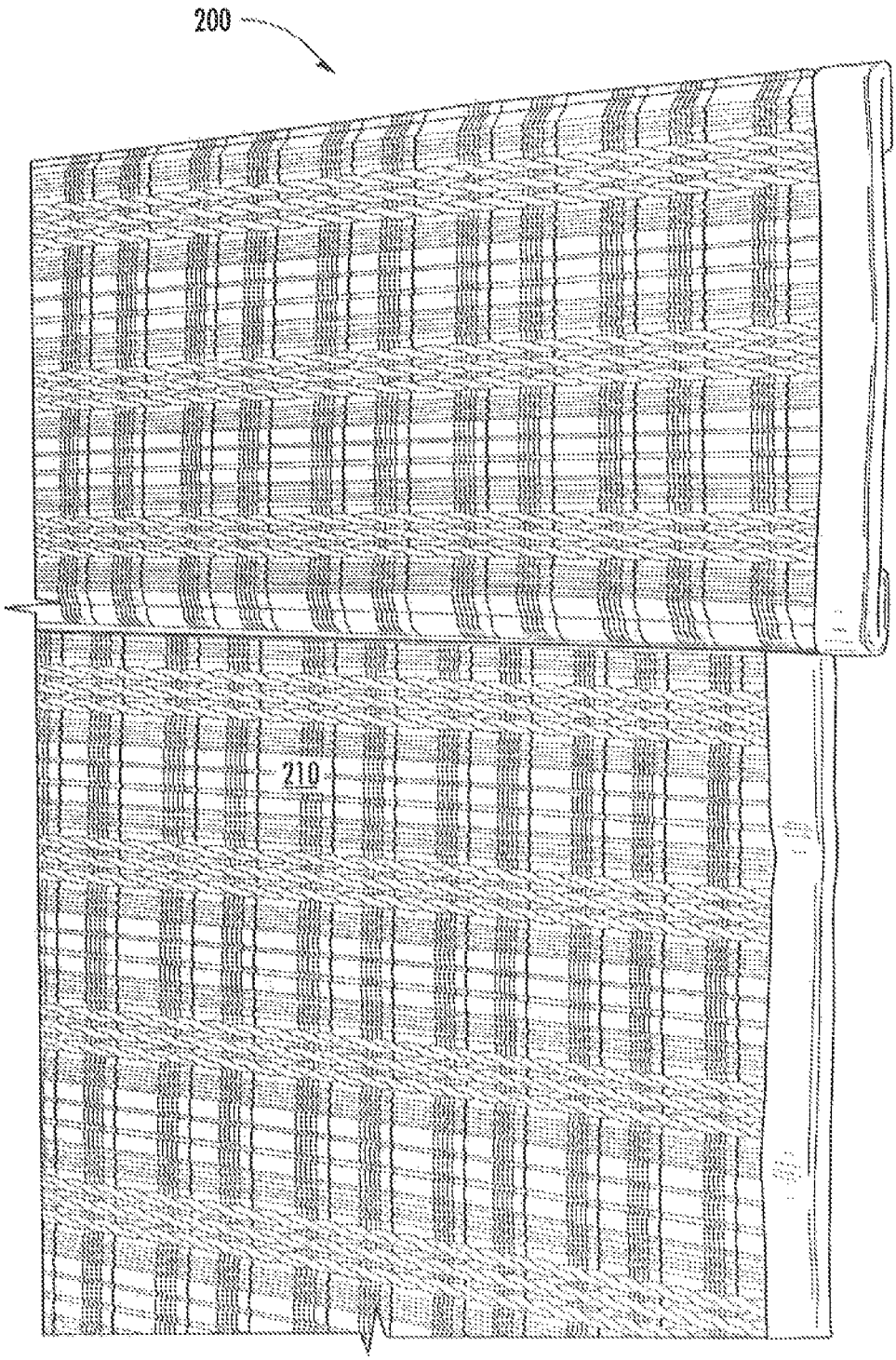
FIG. 12 is another view of the roman shade of FIG. 10.

Referring now to FIGS. 10-12, an alternative embodiment of a roman shade assembly generally 200 is shown. As can be seen, shade assembly 200 includes a backing sheet 202 (shown in a cut-away view in FIG. 10 and FIG. 11). In this particular embodiment the backing sheet 202 is adhered to the back of shade 210. The inclusion of a backing sheet 202 adhered, e.g., laminated, to a shade 210 can improve the overall appearance of a shade assembly 200. For example, when considering a shade 210 formed of a highly textured material, such as a woven wood, the stiffness and texture of the material typically causes skewing to occur on conventional roller shade assemblies. The attachment of a backing sheet 202 to a shade 210 can also provide additional stability to an assembly 200 and prevent skew, shrinking, twisting, edge-to-edge motion, and other motion that can lead to misalignment of a shade.

Similar to the embodiment in FIGS. 3-5, the roman shade assembly 200 includes lift bands 208 wound upon a cylindrical member 215 as particularly shown in FIG. 10. In addition, roman shade assembly 200 includes backing sheet 202 adhered to shade 210. Moreover, backing sheet 202 includes horizontal tabs 206 at intervals along the vertical length of shade 200.

A horizontal tab 206 can extend across the width of backing sheet 202, as shown. In one embodiment, a horizontal tab 206 can be formed by simply folding and taking a gather in the backing sheet material prior to adherence of the backing sheet 202 to the shade 200. Additional stiffness can be incorporated into a horizontal tab, in one embodiment. By way of example, a tab 206 can be formed with a batting material or the like enclosed within or adhered externally to the horizontal tab 206. In general, a horizontal tab will extend from the surface of the shade to a distance of less than about one inch, for instance less than about ¾ inch, or less than ½ inch, in one embodiment.

FIG. 11 illustrates another view of the roman shade of FIG. 10 As can be seen, the horizontal tabs 206 can define openings 222 through which lift bands 208 can freely slide. Thus, openings 222 can serve as slidable connection points between the lift bands 208 and the shade 210. In order to accommodate the lift bands, the openings 222 can be formed with an aspect ratio greater than one, e.g., the openings can be a slit in the horizontal tab. In one embodiment, an opening 222 can define a rectangular or ovoid shape. In any case, the openings 222 can allow the lift band to slide through the opening and retract or extend the shade 200.

The lift band 208 can pass through the openings 222 defined in the horizontal tabs 206 to provide the slidable connection points on the shade system. The vertical distance between adjacent horizontal tabs (and openings therein) can be varied as desired. For instance, adjacent horizontal tabs can be greater than about three inches apart, in one embodiment. The lift points for a specific shade system can be varied as desired through utilization of all or only a portion of the horizontal tab openings. For example, a shade system can include horizontal tabs and openings therein relatively closely together, such as every three inches vertically. If one were to desire a shade with a short drop length (e.g., 1.5 inches), then the lift bands can be threaded through all of the openings along the vertical length of the shade. Alternatively, the same design can be utilized for a shade system having a longer drop length, merely through utilization of only a portion of the openings in the horizontal tabs. If the lift bands are threaded through every other opening in the vertical direction (i.e., horizontal tabs that are six inches apart), then the drop length of the retracted shade will be doubled, to three inches. Similarly, only every third opening, or every fourth opening in the vertical direction can be utilized to provide increasing drop length. Thus, a single design can be utilized with a variety of different looks provided to the shade system. Of course, a system can include horizontal tabs at greater distances, such as greater than about eight inches, with no intervening horizontal tabs in another embodiment.

The lift band 208 can be secured at the hem of the shade 210 at fixed connection points 211, for instance through use of a device as described above, to provide a secured connection point for lifting the shade.

A backing sheet 202 can be formed of any suitable material, for instance a woven or nonwoven web. In one embodiment, a backing sheet 202 can be formed of a relatively low basis weight material, for instance less than about 3 ounces per square yard, and can serve as a light filtering backing for an open weave shade. For example, a low basis weight backing sheet can be translucent and provide some light filtering affects, which can also serve to prevent the lift bands from being visible on the front of the shade assembly 200, the front of which is illustrated in FIG. 12.

Alternatively, a backing sheet can be a material that can provide a black-out capability to a shade assembly. By way of example, a black-out laminate material can be utilized as a backing sheet to maximize the room darkening effect of the window covering when the shade is extended. One exemplary black-out laminate material is a three ply laminate comprising a polyester film such as MYLAR sandwiched between two layers of a spun bonded or spun laced polyester nonwoven material. Black-out laminates of this type are generally known in the art and have previously been used in other types of window coverings.

In one embodiment, the shade material itself can be used to form the horizontal tabs that can define openings through which the lift bands can be threaded. For instance, a shade can be formed of a textile, either a highly textured textile or a textile of more uniform thickness. In either case, the shade material can be folded and gathered during formation to form horizontal tabs across the width of the shade that can then have openings formed therein through which lift bands can be threaded for lifting the shade during retraction. As with a tabbed backing material, a tabbed shade can include additional stiffening material in conjunction with the tabs.

In yet another embodiment, a horizontal tab can be a single horizontal piece, for instance a wooden or molded slat, that can be attached to the back of a shade and define the slidable connection points. For example, a slotted dowel can be attached to the back of a shade to form slidable connection points that are defined by the dowel or formed at the junction between the dowel and the shade. A horizontal tab can extend across all or a portion of the shade system in the horizontal direction as defined above. For instance, a horizontal tab can extend across a shade from edge to edge and define multiple openings therein, each for a different lift band. In another embodiment, a horizontal tab can extend across less than the entire width of the shade, and a single horizontal tab can define only one or multiple openings therethrough for lift bands.

Figure 13A:
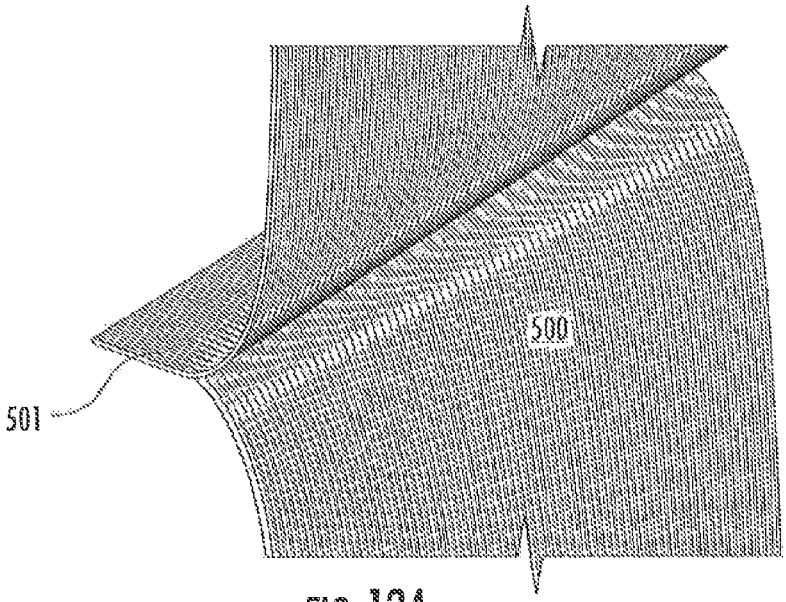
FIGS. 13A-13F present another embodiment of a roman shade system as disclosed herein.

FIGS. 13A-13F illustrate another embodiment in which a band lift system as described herein can be utilized with a backing sheet that is not directly adhered to the shade. For instance, as illustrated in FIG. 13A, a backing sheet 500 can define a horizontal tab 501 that passes across the back of the backing sheet, as shown. In the illustrated embodiment, the horizontal tab 501 is formed from the material used to form backing sheet 500. Of course, other methods of forming a horizontal tab, such as those described previously, may alternatively be utilized.

Figure 13B:
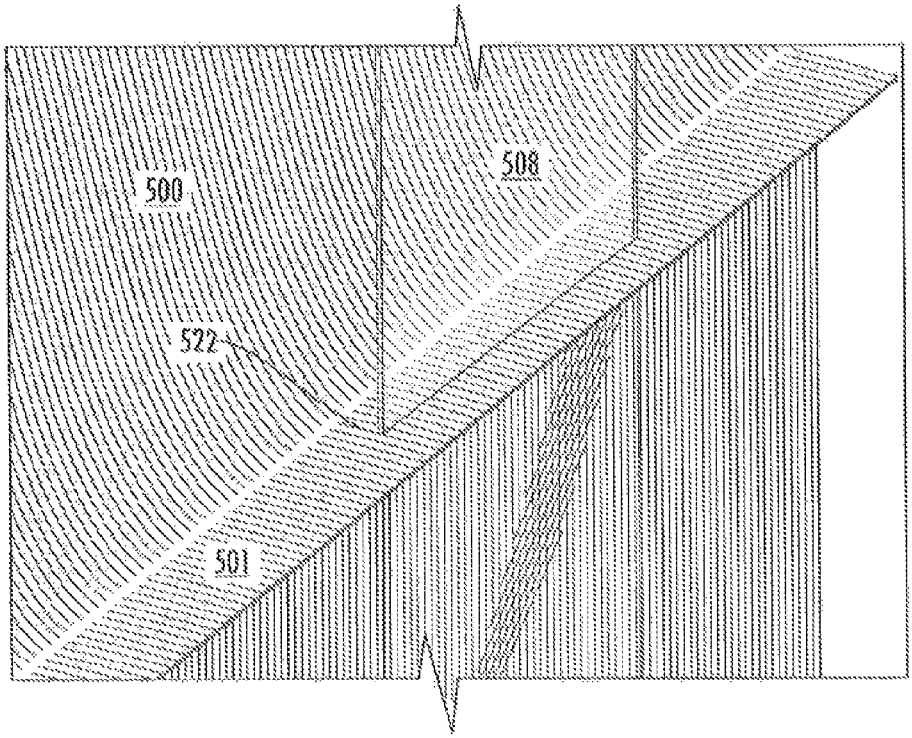
Figure 13C:
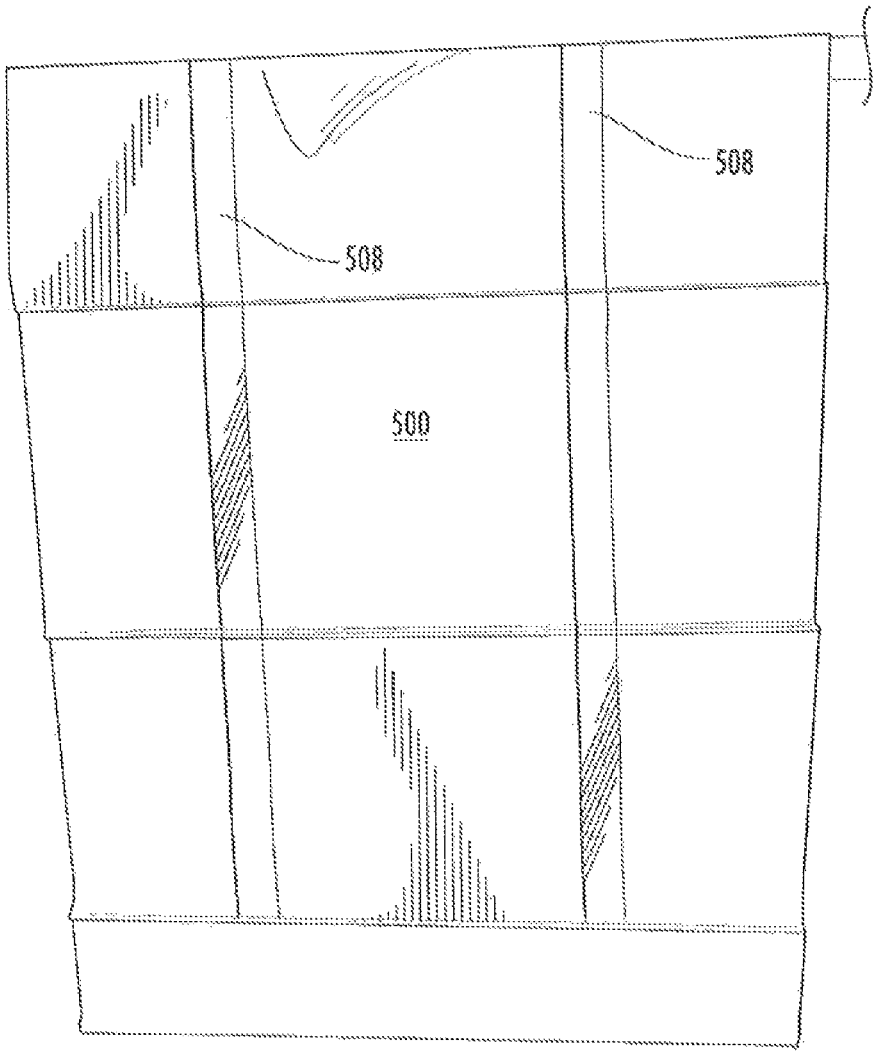
Figure 13D:
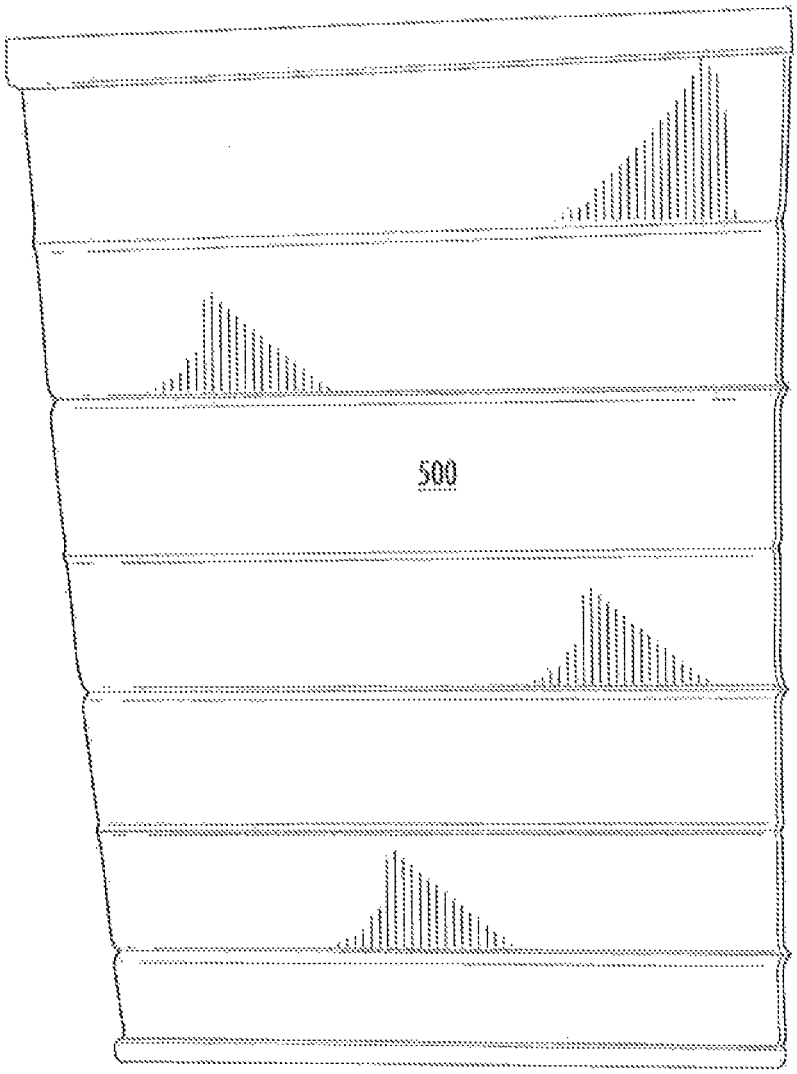

The horizontal tab 501 can define one or more openings 522 therethrough as illustrated in FIG. 13B. A lift band 508 can pass through the opening 522 and thus be slidably connected to the backing sheet 500. FIG. 13C presents a rear view of the complete backing sheet 500. As can be seen, when utilizing a lift band 508 formed of a polymeric tape, the lift band 508 is not overly visible and, in the front view of the backing sheet 500 shown in FIG. 13D, the lift band is invisible, even when the backing sheet is translucent. Of course, a translucent backing sheet is not required and any backing sheet can be used, for instance a black-out-type backing sheet.

Figure 13E:
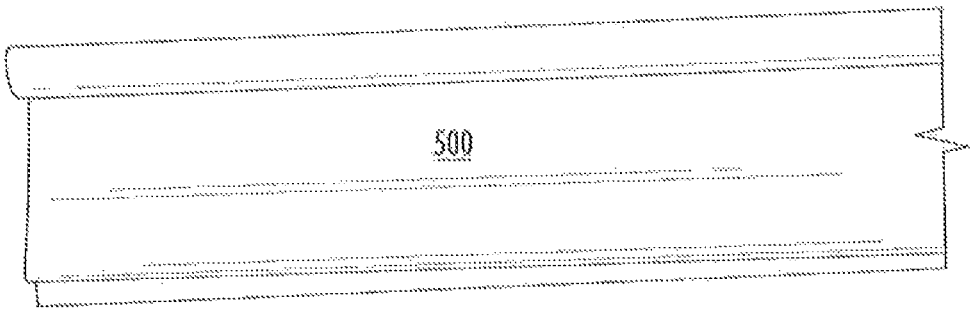
Figure 13F:
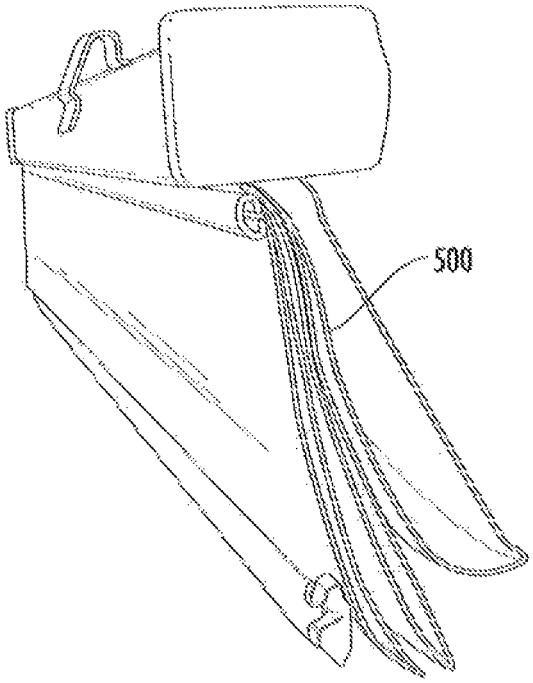

At the hem of the backing sheet 500 the lift tape 508 is secured to the backing sheet 500 with a fastening system such as that illustrated in FIGS. 8A-8E and previously described. Of course, any suitable connection system may alternatively be utilized for securing the lift tape 508 at the hem of the backing sheet. FIGS. 13E and 13F provide two views of the backing sheet 500 fully retracted.

The backing sheet system of FIGS. 13A-13F can be used with a roman shade as described herein or alternatively a different shade system, as desired. For instance, a roman shade assembly 200 as illustrated in FIGS. 10-12, which includes a backing sheet 202 directly adhered to the roman shade, the backing sheet including tabs 206 for attaching lift bands 208, can be combined with a second backing sheet as illustrated in FIGS. 13A-13F that can provide additional light blocking to an assembly.

In one embodiment, a second independent backing sheet can be used in conjunction with an adjacent shade through utilization of a combination lift system as is generally known in the art.

A combination system can include, for instance, a second lift system that includes a single or a plurality of roller assemblies that are utilized to extend and retract the backing sheet behind the roman shade assembly. The second lift system can simultaneously raise or lower the backing sheet to be extended or retracted across a designated portion of an architectural opening. The backing sheet associated with the second lift system can be retracted by use of lift bands and associated roller(s) so that vision through the covering is through the roman shade assembly. In another position, the roman shade assembly can be fully retracted with the backing sheet system also retracted. In still another position, both the roman shade assembly and the backing sheet lift system can be fully extended, to provide additional light blocking capability to a system. In another embodiment, both the roman shade assembly and the backing sheet component can be partially extended to the same or different lengths.

In another embodiment, a backing sheet can be adjacent to a roman shade and the two can utilize a single lift system. For instance, the roman shade and the backing sheet can be aligned back to back and attached to each other at the horizontal tabs between the two. In one embodiment, the horizontal tabs can be defined by the material of the backing sheet and optionally stiffened, and these horizontal tabs can then be attached to the back of the adjacent roman shade.

In another embodiment, the horizontal tabs that define the openings for the lift bands can be formed of a third material (e.g., a polymeric material) and the tabs can be aligned between and adhered to both the roman shade and the backing material. Thus, the lifting system including the lift bands threaded through the openings of the horizontal tabs can lift both the shade and the backing sheet.

As discussed above, the horizontal tabs can generally extend from the surface of the shade and backing material by less than about an inch, for instance less than about ¼ inch, or less than about ½ inch, which will define the space between the shade and the backing sheet when the shade system is hung in an architectural opening.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A roman shade assembly comprising:

a shade having a vertical length including a first end and a second end opposite the first end;

a lift band having a first end and a second end, the second end of the lift band being attached to the shade; and a series of attachment devices attached to the shade such that the series of attachment devices are spaced apart along the vertical length of the shade, each attachment device of the series of attachment devices being adjustable between an opened position and a closed position, and including a pin member that passes through a material of the shade;

wherein:

in the closed position, end portions of each attachment device engage one another so as to form a closed shape configured to fully encircle the lift band, the closed shape defining an opening through which the lift band passes and can freely slide; and the pin member at least partially defines the opening through the lift band passes.

2. The roman shade assembly according to claim 1, wherein the lift band defines an aspect ratio greater than one.

3. The roman shade assembly according to claim 1, wherein the shade comprises a textile or a woven wood.

4. The roman shade assembly according to claim 1, wherein the shade comprises a woven wood.

5. The roman shade assembly according to claim 1, further comprising a backing sheet attached to the shade, the backing sheet being disposed directly between the shade and the lift band.

6. The roman shade assembly according to claim 1, wherein the series of attachment devices are spaced apart such that adjacent attachment devices of the series of attachment devices are more than eight inches apart as measured in the vertical direction of the shade.

7. The roman shade assembly according to claim 1, wherein the lift band is transparent or is translucent.

8. The roman shade assembly according to claim 1, wherein the lift band is a textile or a polymeric tape.

9. The roman shade assembly according to claim 1, wherein the series of attachment devices are removably attachable to the shade such that a vertical position of each attachment device can be varied along the vertical length of the shade.

10. The roman shade assembly according to claim 1, wherein the end portions of each attachment device comprise an end portion of the pin member and a latch configured to hook over the end portion of the pin member when the attachment device is in the closed position.

11. The roman shade assembly of claim 10, wherein the latch corresponds to an end portion of a latch member of each attachment device, the pin and latch members being connected by a bend portion of each attachment device.

12. The roman shade assembly according to claim 1, wherein, in the opened position, the end portions are configured to be spaced apart from one another such that the lift band is insertable between the end portions.

13. The roman shade assembly according to claim 1, wherein the lift band corresponds to a first lift band and the series of attachment devices corresponds to a first series of attachment devices, the roman shade assembly further comprising:

a second lift band having a first end and a second end, the second end of the second lift band being attached to the shade, the second lift band being spaced apart at a distance from the first lift band across a horizontal width of the shade; and a second series of attachment devices attached to the shade such that the second series of attachment devices are spaced apart along the vertical length of the shade, each attachment device of the second series of attachment devices being adjustable between a second opened position and a second closed position and including a second pin member that passes through the material of the shade, wherein, in the second closed position, second end portions of each attachment device of the second series of attachment devices engage one another so as to form a second closed shape configured to fully encircle the second lift band, the second closed shape defining a second opening through which the second lift band passes and can freely slide, the second pin member at least partially defining the second opening through which the second lift band passes, the second series of attachment devices being at a distance from the first series of attachment devices across the horizontal width of the shade.

14. The roman shade assembly according to claim 13, wherein the second end portions of each attachment device of the second series of attachment devices comprise an end portion of the second pin member and a latch configured to hook over the end portion of the second pin member when the attachment device is in the second closed position.

15. The roman shade assembly according to claim 13, wherein each of the first series of attachment devices is entirely separated and spaced apart from each of the second series of attachment devices across the horizontal width of the shade.

16. The roman shade assembly according to claim 1, wherein the lift band is configured to be wound about a rotation axis, the roman shade assembly further comprising a rotatable member adjacent the first end of the shade, the first end of the lift band being attached to the rotatable member, wherein rotation of the rotatable member about the rotation axis in a first direction causes the shade to extend, and wherein rotation of the rotatable member about the rotation axis in an opposite direction causes the lift band to wind around the rotatable member and causes the shade to retract.

17. A roman shade assembly comprising:

a shade having a vertical length including a first end and a second end opposite the first end;

a lift band having a first end and a second end, the second end of the lift band being attached to the shade; and a series of attachment devices configured to be spaced apart along the vertical length of the shade between the first and second ends of the lift band, each attachment device of the series of attachment devices including a pin member that passes through a material of the shade, the pin member at least partially defining an opening through which the lift band passes to provide a slidable connection between the lift band and the shade at a connection point;

wherein the series of attachment devices are removably attachable to the shade such that a vertical position of the connection point associated with each attachment device can be varied along the vertical length of the shade.

18. The roman shade assembly according to claim 17, wherein each attachment device is adjustable between an opened position and a closed position, wherein, in the closed position, end portions of each attachment device engage one another so as to define the opening through which the lift band passes and can freely slide.

19. The roman shade assembly according to claim 18, wherein, in the closed position, each attachment device forms a closed shape that fully encircles the lift band, the closed shape defining the opening through which the lift band passes.

20. The roman shade assembly according to claim 18, wherein the end portions of each attachment device comprise an end portion of a pin member of each attachment device and a latch configured to hook over the end portion of the pin member when the attachment device is in the closed position.

21. The roman shade assembly according to claim 20, wherein the latch corresponds to an end portion of a latch member of each attachment device, the pin and latch members being connected by a bend portion of each attachment device.

22. The roman shade assembly according to claim 18, wherein, in the opened position, the end portions are configured to be spaced apart from one another such that the lift band is insertable between the end portions.

23. The roman shade assembly according to claim 17, wherein, the series of attachment devices are spaced apart such that adjacent attachment devices of the series of attachment devices are more than eight inches apart as measured in the vertical direction of the shade.

24. The roman shade assembly according to claim 17, wherein the lift band is configured to be wound about a rotation axis, the roman shade assembly further comprising a rotatable member adjacent the first end of the shade, the first end of the lift band being attached to the rotatable member, wherein rotation of the rotatable member about the rotation axis in a first direction causes the shade to extend, and wherein rotation of the rotatable member about the rotation axis in an opposite direction causes the lift band to wind around the rotatable member and causes the shade to retract.

25. The roman shade assembly according to claim 17, wherein the lift band corresponds to a first lift band and the series of attachment devices corresponds to a first series of attachment devices, the roman shade assembly further comprising:

a second lift band having a first end and a second end, the second end of the second lift band being attached to the shade, the second lift band being spaced apart at a distance from the first lift band across a horizontal width of the shade; and a second series of attachment devices configured to be spaced apart along the vertical length of the shade between the first and second ends of the second lift band, each attachment device of the second series of attachment devices being configured to provide a slidable connection between the second lift band and the shade at a connection point;

wherein the second series of attachment devices are removably attachable to the shade such that a vertical position of the connection point associated with each attachment device of the second series of attachment devices can be varied along the vertical length of the shade.

26. The roman shade assembly according to claim 25, wherein each attachment device of the first series of attachment devices is entirely separated and spaced apart from each attachment device of the second series of attachment devices across the horizontal width of the shade.

27. A roman shade assembly comprising:

a shade having a vertical length including a first end and a second end opposite the first end;

a lift band having a first end and a second end, the second end of the lift band being attached to the shade; and a series of attachment devices attached to the shade such that the series of attachment devices are spaced apart along the vertical length of the shade, each attachment device of the series of attachment devices being adjustable between an opened position and a closed position;

wherein:

each attachment device includes a pin member and a latch member, the latch member defining a latch configured to hook over an end portion of the pin member such that, when in the closed position, the latch is engaged around the end portion of the pin member and the attachment devices forms a closed shape configured to fully encircle the lift band; and the closed shape of the attachment device defines an opening through which the lift band passes and can freely slide.

28. The roman shade assembly according to claim 27, wherein the pin and latch members are connected by a bend portion of each attachment device, wherein the pin member, the latch member, and the bend portion define the opening through which the lift band passes.

29. The roman shade assembly according to claim 27, wherein the latch is configured to hook over the end portion of the pin member to lock each attachment device into the closed position.

30. The roman shade assembly according to claim 27, wherein the latch is configured to be unhooked from the end portion of the pin member to adjust the attachment device from the closed position to the opened position.

31. The roman shade assembly according to claim 16, wherein the rotatable member is a spool.

32. The roman shade assembly according to claim 16, further comprising a control mechanism in mechanical communication with the rotatable member.

* * * * *